US011758320B1

(12) United States Patent
Taylor

(10) Patent No.: US 11,758,320 B1
(45) Date of Patent: Sep. 12, 2023

(54) SPEAKER ENCLOSURE VENTURI EXPANDER

(71) Applicant: Ronald K. Taylor, Miami, FL (US)

(72) Inventor: Ronald K. Taylor, Miami, FL (US)

( * ) Notice: Subject to any disclaimer, the term of this patent is extended or adjusted under 35 U.S.C. 154(b) by 0 days.

(21) Appl. No.: 16/903,541

(22) Filed: Jun. 17, 2020

(51) Int. Cl.
*H04R 1/28* (2006.01)
*H04R 1/34* (2006.01)
*H04R 1/02* (2006.01)

(52) U.S. Cl.
CPC ..... *H04R 1/345* (2013.01); *H04R 1/021* (2013.01)

(58) Field of Classification Search
CPC .. H04R 1/2815; H04R 1/2819; H04R 1/2823; H04R 1/2826; H04R 1/28
USPC ..... 381/349–352
See application file for complete search history.

(56) References Cited

U.S. PATENT DOCUMENTS 4,949,386 A * 8/1990 Hill ..... H04R 1/44 381/189
7,039,212 B2 * 5/2006 Poling ..... H04R 1/2826 181/149
8,627,920 B2 * 1/2014 Moore ..... H04R 1/30 181/155

* cited by examiner

*Primary Examiner* — Suhan Ni
(74) *Attorney, Agent, or Firm* — Leavitt Eldredge Law Firm

(57) ABSTRACT

A venturi expander is mounted on a speaker enclosure to receive the rearward-propagated sound waves and to extend the propagation path. The venturi expander's reflective sides direct the rearward sound to the sides or top or bottom of the speaker enclosure to produce a reflected sound surrounding the speaker enclosure and producing sound to the sides of the speaker substantially as projected from the front of the speaker.

7 Claims, 8 Drawing Sheets

SPEAKER ENCLOSURE VENTURI EXPANDER

BACKGROUND

1. Field of the Invention

This invention is in the field of speaker systems and in particular to speaker enclosures intended for operation at the lower or bass frequencies of the audio range.

2. Description of Related Art

Speaker enclosures have been used as long as sound was reproduced by a conventional electro-mechanical speaker. Enclosures were used as a structural support to hold the speaker in place and to baffle or reduce the effect of noises or out of phase sound waves, created by the operation of the speaker and which interfered with the reproduction of the a true sound intended to be reproduced. In connection with speakers used to produce bass 13 tones at the low frequency and of the audible range, for example from 150 Hz and below the speaker enclosure had to be made large enough so pressures produced with the creation of the sound frequency waves, did not interfere with the extended movement of the speaker cone at those lower frequencies.

As background, speaker enclosures were built with baffles to extend the path for backwardly projected out of phase audio waves emanating from the rear of the speaker, to prevent these waves from interfering with the forward directed waves from the front of the speaker, because of the production of undesirable elements for example standing waves, air turbulence port noise, whistling, and port chuffing. In the case of speaker enclosures at the lower frequency ranges, the enclosure size had to be large enough to accommodate the pressures created at these lower frequencies which prevented the reduction in the size of the enclosure and prevented the enclosure from being made small so that pressure could not be properly vented without producing the before mentioned undesirable sound effects.

Many attempts have been made to solve the problems created by low frequency enclosures for the purpose of making a smaller size enclosure which do not suffer sound degradation associated with higher internal pressures or backwardly directed waves. For example, U.S. Pat. Nos. 5,517,573 and 4,196,792 show ways of using ports to vent the enclosure so low frequency sounds may be reproduced and whistling diminished and so the size of the speaker enclosure could be made smaller. However, these devices were limited as the use of ports to release the speaker internal pressures while effectively managing the standing wave problem from the backwardly projected waves, prevented a reduction in the size of the enclosure. In connection with the projected sound, a large portion of the sound energy in the backwardly projected sound was lost as the object was to reduce the effect of the speaker on the air mass inside the speaker enclosure and the efficiency of the speaker was reduced as the energy associated with the backwardly projected sound wave were not effectively utilized to enhance the sound produced by the speakers. While U.S. Pat. No. 4,231,445 made an attempt to disperse the backwardly or rearwardly projected sound waves, relative to the forward projected sound waves from the front of the speaker, the rearward sound waves were not utilized to project the sound around the speaker enclosure or to extend the sound path relative to the length of the sound waves at the lower frequency range to prevent or minimize degradation of the total sound from the speaker.

SUMMARY OF THE INVENTION

The venturi expander invention disclosed herein in its preferred embodiments and according to the principles of the disclosed invention, overcomes the problems of the prior art devices in removing or relieving the pressures in the speaker enclosure which impede the movement of the speaker cone at low frequencies, for example at 150 Hz, and below, without the accompanying distortion of port noise such as whistling or port chuffing. The venturi expander operates with improved venting; reducing the internal pressure of the enclosure and permits the volume and size of the enclosure to be reduced. Speaker size reduction using the venturi expander can be accomplished without sacrificing an extended audio path to disperse the backwardly or rearwardly projected out of phase sound waves so their reflections do not create cancellation by the mixing of out of phase rearward sound waves with the forward projected sound waves from the front of the speaker.

The efficiency of the speaker enclosure is enhanced by the venturi expander by providing a path for dispersing the backwardly or rearward projected sound waves, in an extended path through surfaces which direct the movement of the sound waves out of the enclosure in a compound path transverse to and through bell ports placed in the speaker enclosure, extending the path of the sound waves by reflection in the transverse direction while the propagation of the sound waves is through the bell ports. An air port tube in line with the rear of the speaker and opposed to the rear of the speaker is vented at the rear wall of the enclosure, providing a tube like path for relieving the pressure built up in the enclosure around the speaker. The sound waves propagating in a compound path out of the bell ports are in a pattern that causes reflection of the sound waves from the sides, top and bottom of the speaker enclosure and residual sound waves via air port tube exhaust. These sound waves contribute to a 360-degree pattern when combined with the sound waves projecting from the front of the speaker.

The compound sound propagation path is through the speaker enclosure rear wall port opening and the inlet to the bell ports and through the bell ports to the bell port opening, and projecting the rearward sound waves at an angle to the forward sound waves projected from the front of the speaker. The effect is that of a surround sound or 360 degree sound, so for example, in a live performance musicians playing at the sides or rear of an instrument amplified by a venturi expander design speaker enclosure may hear the sound waves from that instrument as do those musicians sitting in the path of the forward projected sound waves.

The bell ports, according to the principles of the venturi expander and as shown in a preferred embodiment of the invention, receive the sound waves emitted from the rear of the speaker and reflected from the interior side walls of the speaker enclosure and exterior of air port tube, and are arranged to reflect the sound back and forth against the rear exterior wall of the speaker enclosure and the sides of the bell ports. In a preferred embodiment, the sides of the bell port are stepped with the distance between the sides of the bell port and the rear wall of the speaker increasing in the direction of propagation from the bell port inlet to the bell port opening. In this way the reflected waves will move obliquely with a direction component transverse to the direct propagation path through the bell port, extending the propagation path and reducing the effect out of phase sound waves would have on the forward propagated waves from the front of the speaker. At the same time, the energy in the rearward propagated sound waves is not lost or reduced to produce the effect of 360-degree sound wave dispersion.

In accordance with the principles of the invention and the preferred embodiments disclosed, the air port tube extending through the rear wall of the enclosure and through the venturi expander, is in line with, and opposed to the rear of the speaker and vents the higher than ambient air pressure out from the enclosure. The tube may be of a varying size and is placed opposed to the rear of the speaker to effectively vent the internal pressure created by the operation of the speaker. The small size of the air port tube inlet port relative to the cross sectional area of the speaker at the inlet port, allows the flow of air and the release of pressure without interfering with the backwardly projected sound waves reflected internally from the walls of the speaker and the exterior radial wall of the air port tube and out the bell ports. The air tube cross sectional area may be reduced where the size of the speaker is made smaller and may be blocked where the size of the speaker does no create pressure levels impeding the movement of the speaker cone. In this way, the air port tube may be adjusted to accommodate any size speakers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
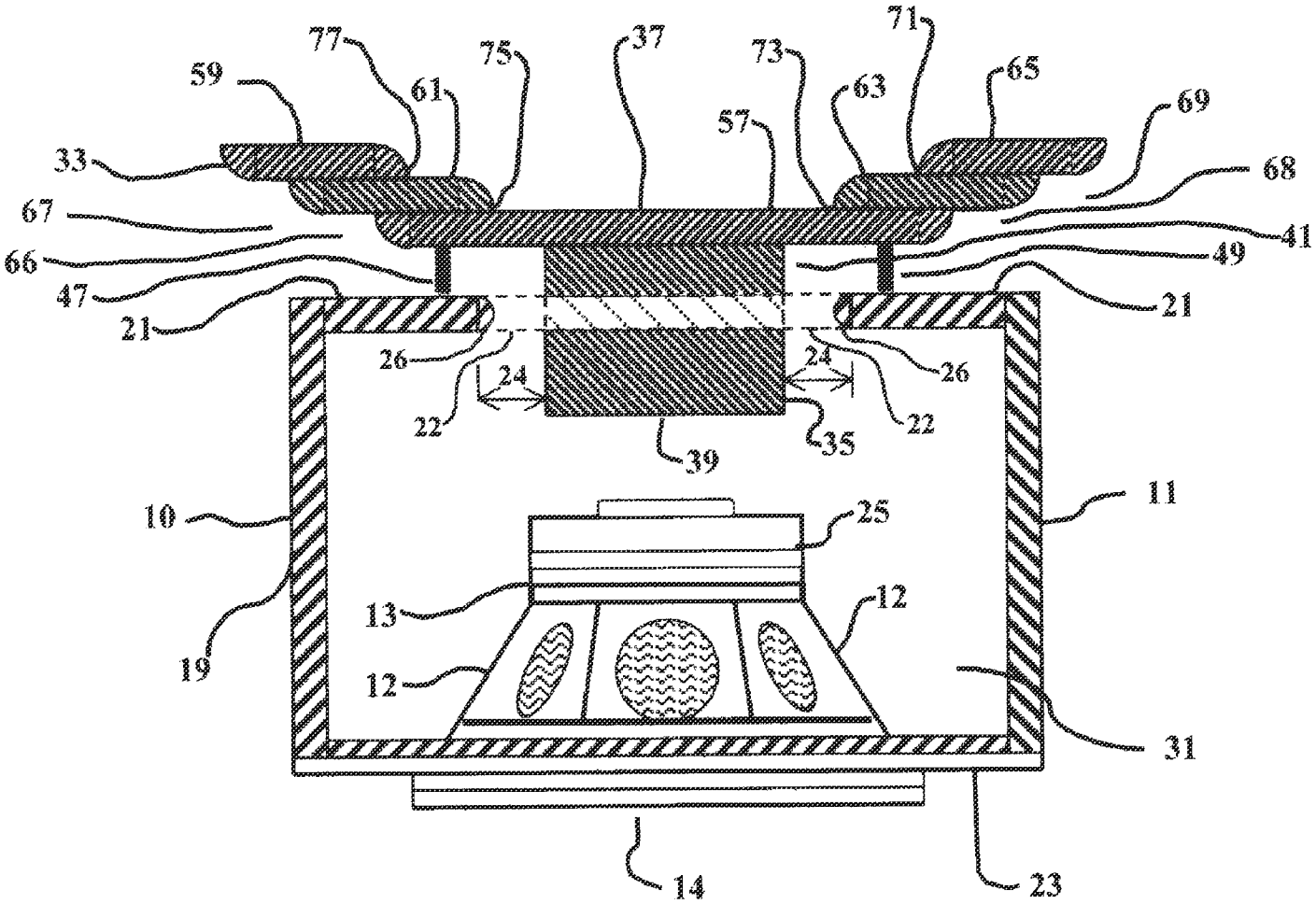
FIG. 1 shows the interior of the speaker enclosure in a top view down into the enclosure with the speaker top removed and with the venturi expander attached to the rear wall of the speaker enclosure.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views. FIG. 1 in a top view generally shows a preferred embodiment as a speaker enclosure 10. The enclosure is shown in a top view looking into the enclosure with the top cover removed. The speaker enclosure 10 as seen in this top view, is made of front wall 23, side walls 11 and 19 and rear wall 21. Projecting through the front wall 23 is the front or forward propagation direction 14 of speaker 13. The venturi expander is shown generally by numeral 33 and is mounted to the rear wall 21 by means of mounting pins 47 and 49. Passing through rear wall 21 is an air port tube 35 extending into the speaker enclosure 31, with an inlet port 39 opposed to the rear of speaker 13, shown generally by numerals 12 and 25, and a flared portion 41 terminating in outlet port 37. Surrounding the air port tube 35 is a circular port opening through rear wall 21 shown by numeral 22 and having a radial width shown by numerals 24.

Figure 1A:
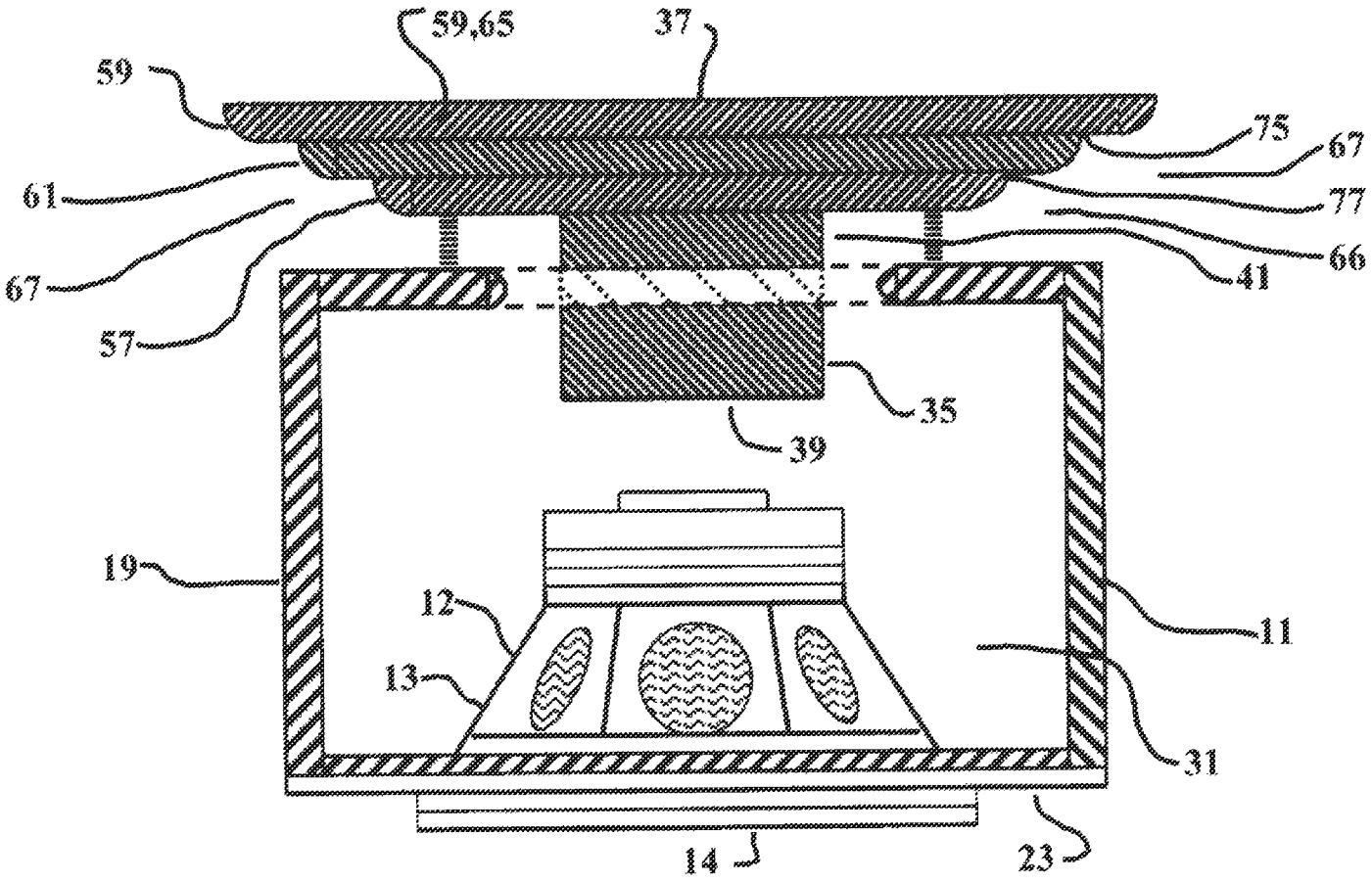
FIG. 1*a* shows the interior of the speaker enclosure, as shown in FIG. 1 and with circular stepped walls of the venturi expander forming a continuous bell port, corresponding to the rear view of FIG. 2*a*.
Figure 2:
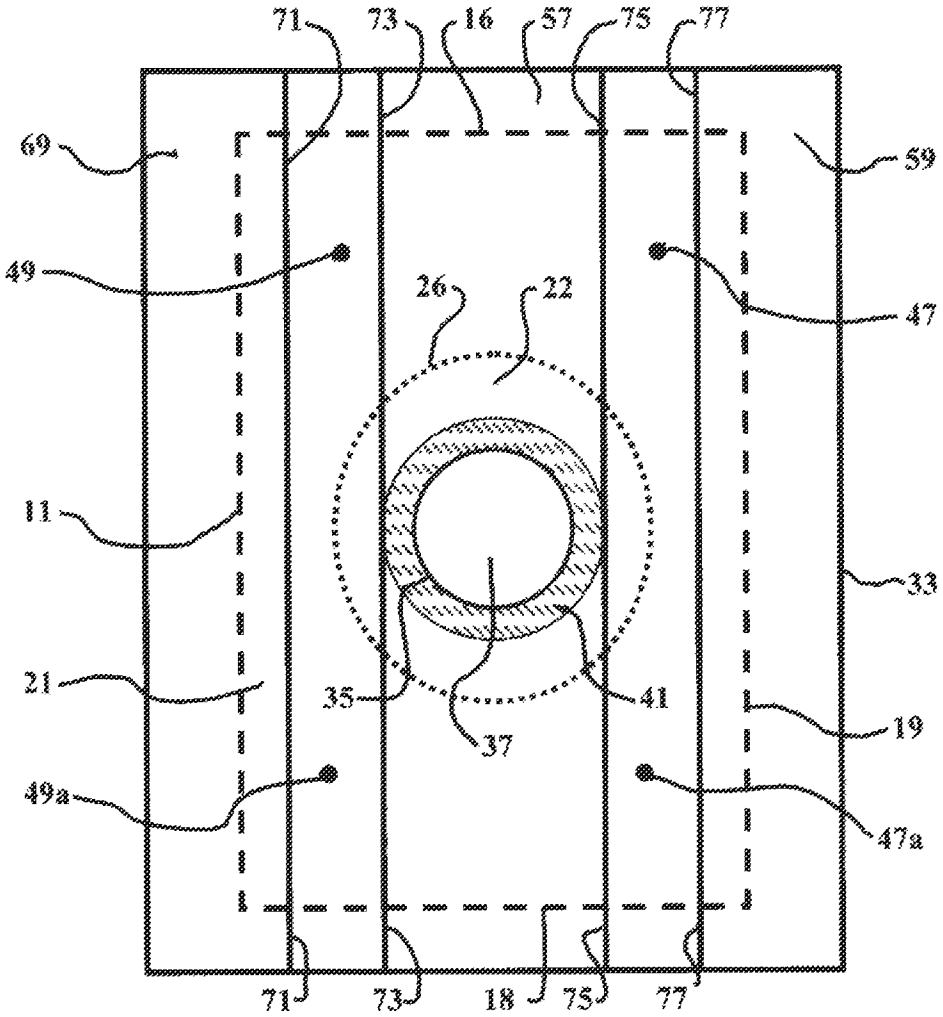
FIG. 2 shows the venturi expander in a rear view with the rear wall and the opening in the rear wall through which sound waves may propagate from the rear of the speaker to the venturi expander.
Figure 2A:
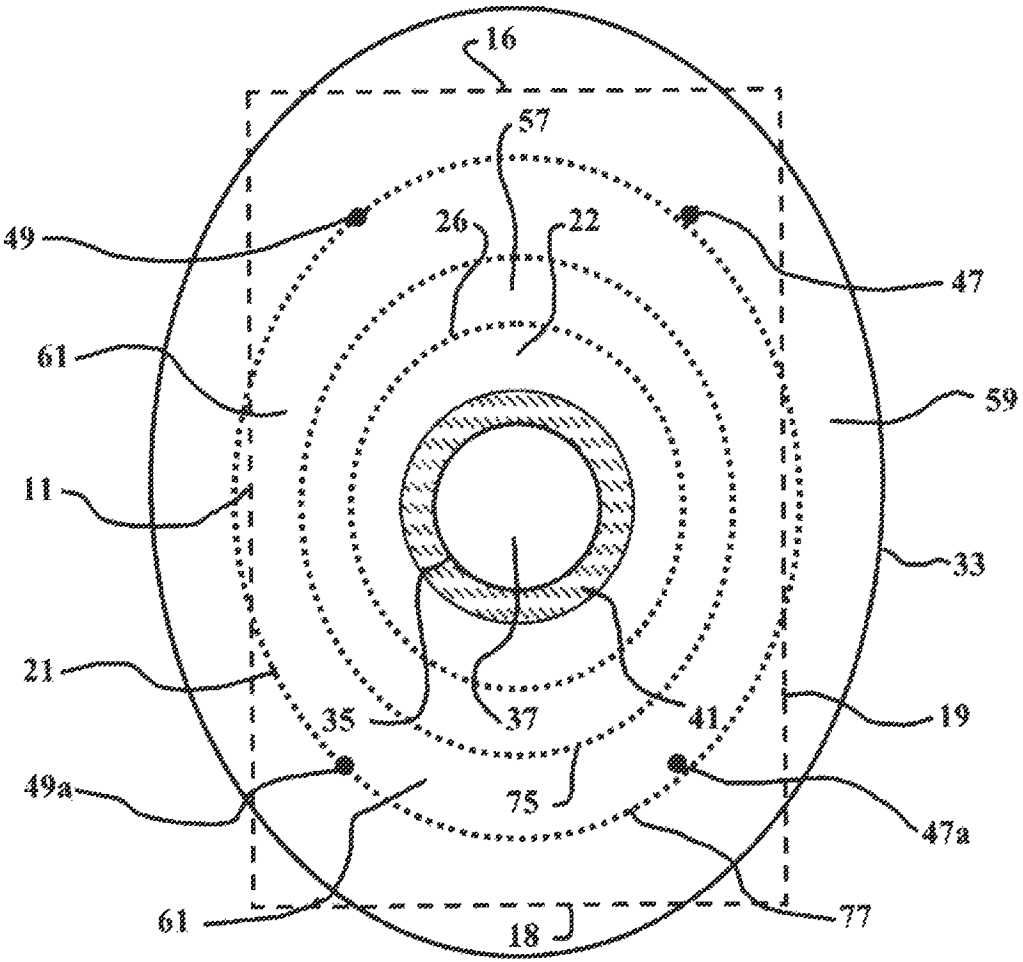
FIG. 2*a* shows the venturi expander in a rear view and with circular stepped walls of the venturi expander forming a continuous bell port.
Figure 4:
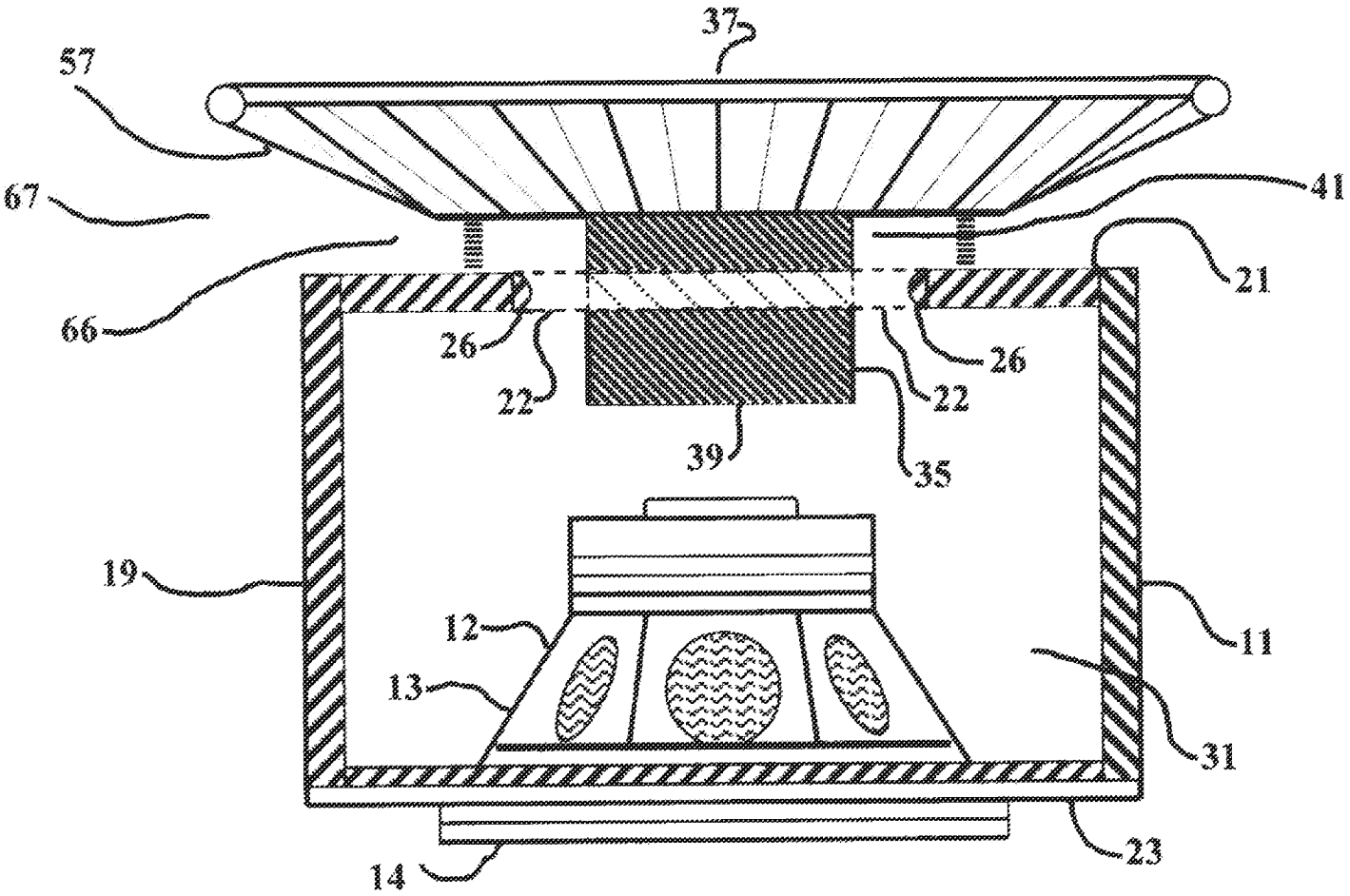
FIG. 4 shows the venturi expander with a circular port bell and with the wall of the circular bell port being made continuous.

As may be seen in FIG. 1, the venturi expander includes one or more bell ports shown as bell ports 66 and 68, with respective bell port openings to ambient 67 and 69, located to receive sound from the rear 12, of speaker 13 propagated toward the venturi expander, through circular port 22 opening in rear wall 21. An air port tube 35 is shown in a preferred embodiment as in line and opposed to the rear 25 of the speaker 13, extends through rear wall 21 and terminates in a flared section 41 opening 37 to ambient. The inlet of the air port tube is proximate the rear 12 of speaker 13 to place the inlet in an area of higher pressure relative to ambient. The bell ports 66 and 68, as shown in a preferred embodiment, may be formed of stepped sides as shown in FIG. 1 or in a continuous side as shown in FIG. 4, arranged so the stepped side or the continuous side, are increasingly displaced from the rear wall 21 in the direction of direct sound propagation from the rear of the speaker 13 through the bell port inlet, formed in a preferred embodiment as shown in FIG. 1, by the circular port opening 22, the rear wall 21 and the reflective surface 57 and the bell port comprising the bell port reflective surfaces 57, 59, 61, 63 and 65 and the bell port openings 67 and 69, creating or defining a passage of increasing width in the direction of the bell port openings 67 and 69. Bell port walls are shown by numerals 59 and 61 in stepped relation with each other and with bell wall 57 and forming bell port 66 with bell port opening 67, and by bell port walls 63 and 65 in stepped relation with each other and with bell wall 57 and forming bell port 68 with bell port opening 69. As shown in FIG. 4, a continuous bell port wall 57 may be used instead of the stepped walls as described. As would be understood by those skilled in the art, the bell port walls as shown by numerals 59, 61, 63, and 65, may extend beyond the side walls 11 and 19 and the top 16 and bottom 18, of speaker enclosure 10, as shown in FIGS. 2 and 2*a*, or be coextensive with, or less than the dimensions of these speaker wall 11, and 19 or top 16 or bottom 18. The bell port walls 59, 61, 57, 63, and 65, may be arranged relative to each other in a coaxial fashion as shown in FIGS. 1*a* and 2*a*, or be one continuous wall as shown in FIG. 4, or may be varied in any other suitable way, consistent with the principles of the disclosed invention.

The circular port opening 22 is shown in phantom in rear wall 21 with radial width 24 extending from the outer wall of the air port tube 35 to the outer radial edge of the circular port 22. As would be understood by those skilled in the art, the circular port opening 22, in the propagation path of the sound waves from rear 12 of speaker 13, to the venturi expander 33, may be varied in shape and size and be made in one continuous opening or may be discontinuous sections in the same radial distance from the axis of the air port tube 35 or in a plurality of continuous openings centrally or non-centrally placed in the rear wall 21 of speaker enclosure 10.

The seams where the stepped walls overlap are shown by numerals 71, 73, 75 and 77. As shown in FIGS. 1*a* and 2*a*, where the stepped walls are concentric or coaxial, the seams are shown as circular.

The rear of the venturi expander is shown in FIG. 2 in which the same numerals as in other Figures show the same or similar parts, with rear wall 21 of the speaker shown in phantom. Mounting pins 47, 47*a* and 49 and 49*a* are shown supporting the venturi expander 33 on speaker enclosure rear wall 21. The outlet port 37 of the air port tube 35 is shown with its flared portion 41. Surrounding the air port tube 35 is the circular port 22 in rear wall 21 and extending radially from the air port tube 35 to the outer edge 26 of the circular port 22, in the radial width shown by numeral 24 in FIG. 1.

Referring to FIG. 1, the bell ports 66 and 68 are shown with the stepped walls 57 and 63 and 65 for bell port 68 and it bell port opening 69 to ambient and 59 and 61 for bell port 66 and its bell port opening 67 to ambient and extending away from the rear wall to define an increasing opening in the direction of direct propagation of the sound from the interior 31 of the speaker through the circular port 22 and to the stepped walls of the bell ports 67 and 68. As would be apparent to one skill in the art, the stepped walls may be circular, or coaxial or arranged in any other suitable arrangement which achieves the effect of a widening sound port in the direction of propagation. In a preferred embodiment, the stepped walls overlap each other in circular seams as shown in FIG. 2 and FIG. 2*a*, the venturi expander bell ports may extend beyond side walls 11 and 19 and top 16 and 18, all shown in phantom view.

A preferred embodiment as shown in FIG. 1*a* and FIG. 2*a*, shows a continuous circular bell port instead of the two separate bell ports 67 and 69 as shown in FIG. 1. The outer most stepped circular wall is shown by numeral 59, the intermediate stepped circular wall is shown by numerals 61, and the overlapping seams by numerals 77 and 75. A top view of the venturi expander as shown in FIG. 1 is as shown in FIG. 1*a* with circular walls as shown in FIG. 2*a*. As would be known to those skilled in the art, the shape or size of the reflecting walls and the shape and size of the opening shown, may be varied without departing from the principles of disclosed invention. In particular, the bell ports may be constructed with reflecting surfaces separate from the surfaces of the rear wall, without departing from the disclosed inventive principles.

As would be understood by one skilled in the art, the bell ports 66 and 68 as shown in FIG. 1 and FIG. 2 or the circulars bell port as shown in FIGS. 1*a*, and 2*a*, may be varied by sectioning the continuous bell port of FIGS. 1*a* and 2*a* or making the outer stepped wall extend beyond or coextensive with the top, bottom and sides of the speaker enclosure side walls 11 and 19 and top and bottom 16 and 18, or of a smaller dimension or change the shape or location of the circular port 22. In accordance with the principles of the invention, the cross section of the air port tube 35, the distance between the stepped walls of the bell ports 67, 69, and the size and shape placement of the port 22 in rear wall 21, may be varied from that shown in a preferred embodiment to derive the best performance of the venturi expander consistent with the size of the speaker and the speaker enclosure.

As seen in FIGS. 1 and 2, the outermost stepped wall of the bell ports 66, 68, extend beyond the side walls 11 and 19 of the speaker enclosure. Depending on the performance desired from the venturi expander, the bell ports as formed by the stepped walls, may be extended beyond the top 16 and bottom 18 of the speaker, as explained above.

Figure 3:
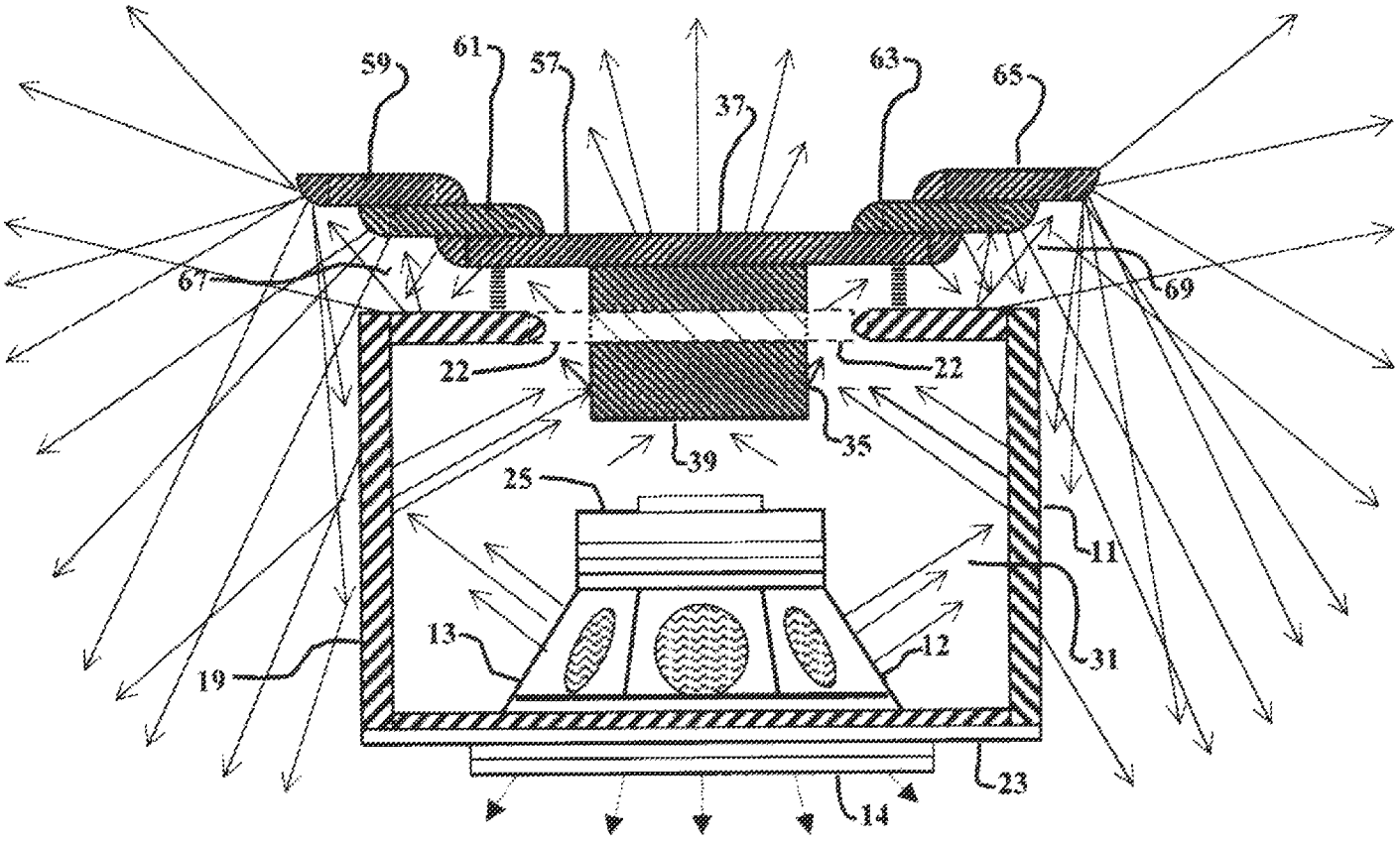
FIG. 3 shows the venturi expander is schematic form to show the propagation paths of sound from the rear of the speaker to the bell ports and to ambient from the port bell openings.

The operation of the venturi expander as shown in preferred embodiments above or as may be varied by one skilled in the art is explained with reference to FIG. 3, wherein the venturi expander is shown in schematic form showing the sound propagation scheme of the venturi expander. In the schematic of FIG. 3, the same numerals are used to show the same or similar parts as in all other drawings. The arrows shown without numerals represent the sound energy in the form of acoustic sound waves produced by speaker 13 from its front 14 in the form of forward propagated sound waves and to the rear from its back 12 in the form of rear propagated sound waves. Sound waves propagated from the rear 12 of speaker 13, are in a path toward the rear wall 21 along air port tube 35 and reflected from the sides 11 and 19. The air port tube 35 placed in line and opposed to speaker 13, provides an exhaust for the higher than ambient air pressure produced by the movement of the cone of speaker 13 and serves as an exhaust for that pressure as would be well known to those skilled in the art. With the exhaust of the air through air, port tube 35 is residual sound, which is passed to ambient through air port tube outlet port 37.

The sound directed to the sides and along the sides of air port tube 35, propagates out the circular port opening, as shown in a preferred embodiment 22 and to the stepped reflecting surfaces 57, 63 and 65 and 57, 61 and 59 and out to ambient through respective bell port openings 67 and 69. These reflecting surfaces cause the sound waves to move in a reflective path in an oblique path with a directional element transverse to the direct sound propagation path from the bell port inlets through the bell ports 66, 68, to the bell port opening and out of out bell ports openings 69 and 67, As the sound waves propagate through the widening path of the port bells shown in FIGS. 1, 1*a*, 3, and 4, the sound propagation pattern of the sound waves is spread about the bell port at its openings 67 and 68 into ambient causing the sound waves to be directed out from the speaker, with a portion of the sound energy being directed to, and reflected off the sides 11, 19, or in the case where the venturi expander extends beyond the top 16 or bottom 18, of the speaker enclosure, as shown in FIGS. 1*a* and 2*a*, with a portion of the sound energy being directed to and reflected off the top or the bottom of the speaker enclosure. In this way, the sound from the speaker sides produces the effect of sound radiating around the speaker with reference to the front to back direction of the speaker enclosure from the front wall 23 to the rear wall 21.

The propagation path of the sound waves from the rear 12 of speaker 13 is extended or elongated by reflection within the speaker enclosure 31, by the interior of the side walls 11 and 19 and the exterior of air port tube 35 and by reflection within the bell ports 66 and 68 which alter the direct sound propagation path and extend it by directing the sound waves obliquely to the direct sound propagation path with a directional element transverse to the direct sound propagation path by reflection between the reflective surfaces of the bell ports, as shown in FIG. 3. As the sound waves propagate, through the widening path of the port bells, 66 and 68, the sound waves are caused to move more slowly, reducing the potential for interference with the forward propagating sound waves from the front 14 of speaker 13. The sound waves propagating out of bell port outlets 67 and 69, are dispersed obliquely to, or directly with, or sideways from, the front to back direction of the speaker enclosure, or the direction of sound propagation in a forward direction from the front of the speaker, and substantially around the speaker enclosure, for example radiating substantially about the axis of the air port tube 35 and radiating towards the front of the speaker enclosure and to the rear of the speaker enclosure as shown in FIG. 3, by propagation paths from the bell ports 66, 68, or from the bell ports to and from the sides 11, 19, or top 16 or bottom 18, of the speaker enclosure 10 and by the residual sound from the air port vent tube 35. In this way, the object of spreading the sound about the speaker enclosure radially outward from the sides of the speaker enclosure is so musicians sitting at the side of the amplified sound of 5 another musician, can hear the same music or sounds as those in front of the speaker enclosure.

Various adjustments may be made to the shape of the port bells, the air port tube, the size of the ports used in the propagation path and the distances between the elements without departing from the principles of the invention. For example, as shown in FIG. 4, the circular port bell shown in FIGS. 1*a* and 2*a*, may be a continuous wall instead of a stepped wall. As would be known to those skilled in the art, the sound patterns may varied by varying the configuration, size and spacing of the various parts of the venturi expander, without departing from the principles of the invention as shown and disclosed.

Figure 5:
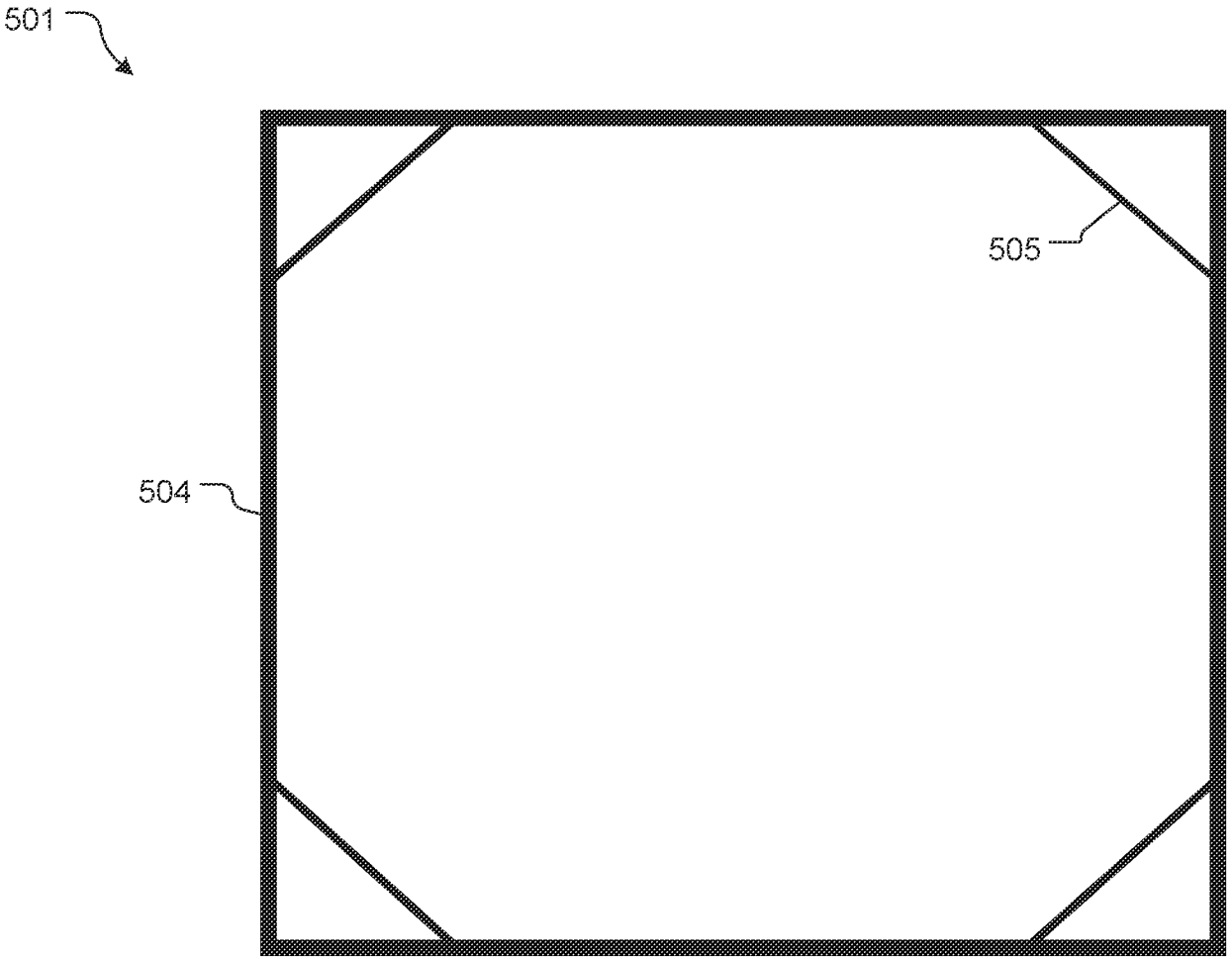
FIG. 5 shows a first embodiment of a reflection panel for use with the speaker enclosure of the present invention.
Figure 5A:
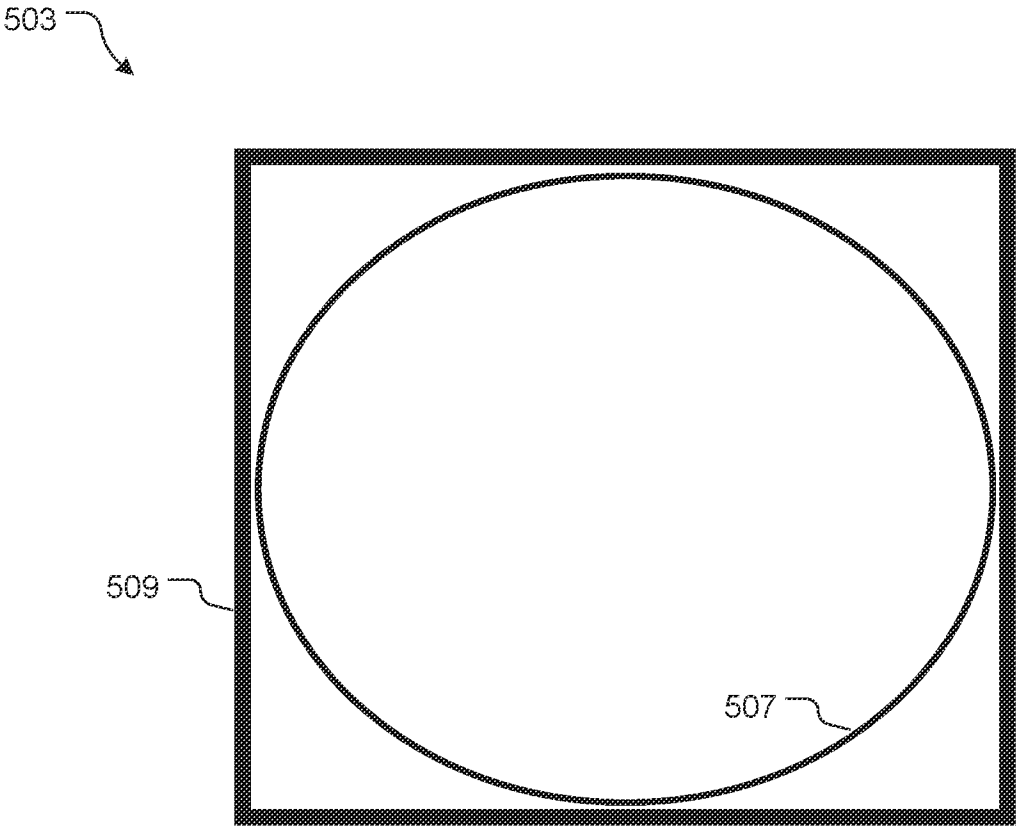
FIG. 5*a* shows a second embodiment of a reflection panel for use with the speaker enclosure of the present invention.

In FIGS. 5 and 5*a*, two embodiments of reflection panels 501, 503 are shown. The reflection panels are configured to be incorporated into the speaker enclosure of the present invention. Panel 501 includes a body 504 and a plurality of hard surfaces 505 positioned around an interior of the body. The plurality of hard surfaces will reflect soundwaves. Similarly, panel 503 includes an interior hard surface 507 inside of body 509. It should be appreciated that the angle of the hard surface can vary as needed and desired by the user. It should be appreciated that the reflection panels can be mounted internally or externally relative to the enclosure (See 10 FIG. 1). The mounting can be achieved via any known means.

It should be appreciated that the user of one or more reflection panels 501, 503 is believed to be a novel feature of the present invention. In most embodiments, the panels provide for symmetrical hard surfaces, as shown in the figures, which provides for rearward propagating sound that is in harmony and in-phase with the forward emanating in-phase sound waves of the mounted transducer.

The size of the reflection panels will be determined by the size of the diameter of the transducers moving cone. A full range speaker enclosure with a common 12-inch transducer has a effective moving cone diameter of 10 inches. The measurement of 10 inches is then multiplied by 3.14 equals 31.4-inches then divided by 2 equals 15.75-inches, continued dividing down to 0.49 inches or lower depending on application this is used for making smaller hard, reflective panels or a circular internal wall in this example to achieve a clear in-harmony, in-phase sound, projecting and propagating out the rear port. The common area measurement of a circle is A Pi×r2 can be used for large speaker cabinet reflective panels when large cabinets are desired.

When the rearward propagating sound passes through the rear port, it is further tuned via the rear mounted wing connected to the rear port of the before mentioned example. This wing is also designed and made with subdivided, hard reflection panels using the same 10-inch diameter measurement formula.

The formula can be modified by choosing a point midway center on the transducer moving cone, to achieve a focused midrange frequency for 3-way and 4-way sound systems. This formula can also be implemented by using any point from smallest point to outer edge of a transducers moving cone. The use of this application formula is also effective with all sizes of speaker transducers ranging from 1 inch and increasing in size through to the new, at this point in time 21 inch max transducer.

The angles of the panels also follow the same formula by using the degrees of angle the cone is designed, instead of inches. Example cone A, on mounted transducer is 45 degrees of angle subdivide by 2 is 22.5 usable degrees of angle. This tuning formula provides additional important improvements to the efficiency, durability linearity of tone travel and higher audio output. The wattage handling goes beyond the transducer manufacturers recommended maximum wattage rating.

The improved formula affords balanced air movement around the transducer magnet and voice coil in a smooth, equal pressure jet stream out the rear port to ambient.

This balanced air movement keeps the cone moving in an undisturbed manner, keeping the voice coil traveling in and out of the magnet coil gap without rubbing against the gap wall. When the voice coil rubs against the magnet gap wall, friction occurs causing high heat build up on sections of the copper or aluminum voice coil winding wires. Thermal overload occurs causing transducer failure, commonly called a blown speaker. The typical conventional speaker cabinet does not address balanced air travel, resulting in enclosure internal air turbulence, causing the transducer cone to be pushed in a travel disturbing erratic movement instead of solid in and out parallel movement inside the magnet gap.

This balanced air movement also distributes the heat emanating off the magnet motor assembly in a uniform manner. This evenly heated air warms the transducer motor and mounting basket so no micro physical shape distortions occur. The entire transducer structure expands and contracts uniformly.

Because the speaker cabinet can be made swallow, the heated air is exited to ambient quickly further cooling the operation of the transducer motor.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A speaker enclosure venturi expander, comprising, a speaker enclosure having a front wall, rear wall, and a side wall;

a speaker mounted within the speaker enclosure;

a bell port means positioned to receive sound from the speaker and direct the sound through an opening, the bell port means includes:

at least one bell port having a bell port inlet opposed to a speaker rear of the speaker, the at least one bell port having a plurality of sound reflecting surface placed relative to each other to reflect sound in respective oblique sound propagation paths, in opposed directions relative to each other; and a reflection panel mounted to the speaker enclosure, the reflection panel having one or more hard surfaces for sound reflection.

2. The expander of claim 1, wherein the one or more hard surfaces for sound reflection are symmetrically arranged.

3. The expander of claim 1, wherein the reflection panel is mounted to an exterior of the speaker enclosure.

4. The expander of claim 1, wherein the bell port includes a direct propagation path from the bell port inlet to the bell port opening and wherein the plurality of respective oblique sound propagation paths, in opposed directions relative to each other, cross said direct propagation path.

5. The expander of claim 1, wherein the bell port means includes a bell port opening with at least one bell port opening reflective surface and the at least one bell port opening surface is arranged relative to a side wall of the enclosure to reflect sound in a side propagation path from the at least one bell port opening to the side wall and from the side wall to ambient.

6. The expander of claim 1, further comprising:

an air port tube having an inlet opposed to a speaker rear and an outlet of the air port tube proximate to a rear wall of the enclosure.

7. The expander of claim 1, further comprising:

an air tube vent means for exhausting a high pressure air relative to ambient.

* * * * *